US009290705B2

(12) United States Patent
Bourane et al.

(10) Patent No.: US 9,290,705 B2
(45) Date of Patent: Mar. 22, 2016

(54) PROCESS FOR HIGH SEVERITY CATALYTIC CRACKING OF CRUDE OIL

(71) Applicant: Saudi Arabian Oil Company, Dhahran (SA)

(72) Inventors: Abdennour Bourane, Ras Tanura (SA); Musaed Salem Al-Ghrami, Dhahran (SA); Ibrahim A. Abba, Dhahran (SA); Wei Xu, Dhahran (SA); Kareemuddin M. Shaik, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 335 days.

(21) Appl. No.: 14/050,708

(22) Filed: Oct. 10, 2013

(65) Prior Publication Data

US 2014/0110308 A1 Apr. 24, 2014

Related U.S. Application Data

(60) Provisional application No. 61/716,051, filed on Oct. 19, 2012.

(51) Int. Cl.
*C10G 51/06* (2006.01)
*C10G 11/18* (2006.01)

(52) U.S. Cl.
CPC ..... *C10G 51/06* (2013.01); *C10G 11/18* (2013.01); *C10G 11/182* (2013.01); *C10G 2300/201* (2013.01); *C10G 2300/205* (2013.01); *C10G 2300/708* (2013.01)

(58) Field of Classification Search
CPC ..... C10G 51/06; C10G 11/182; C10G 11/18; C10G 2300/708; C10G 2300/201; C10G 2300/205
See application file for complete search history.

(56) References Cited

U.S. PATENT DOCUMENTS

| | | | | |
|---|---|---|---|---|
| 4,097,363 | A | 6/1978 | McKinney et al. | |
| 5,328,591 | A * | 7/1994 | Raterman | C10G 11/18 208/108 |
| 5,455,010 | A | 10/1995 | Lomas et al. | |
| 5,582,712 | A | 12/1996 | Zinke et al. | |
| 6,916,417 | B2 | 7/2005 | Mayes | |
| 7,029,571 | B1 | 4/2006 | Bhattacharyya et al. | |

(Continued)

FOREIGN PATENT DOCUMENTS

| | | | |
|---|---|---|---|
| CN | 101164686 | B | 5/2010 |
| WO | 2012/004805 | A1 | 1/2012 |
| WO | 2013/142563 | A2 | 9/2013 |

OTHER PUBLICATIONS

PCT/US2013/064233 International Search Report and Written Opinion, Mar. 31, 2014.

*Primary Examiner* — Randy Boyer
*Assistant Examiner* — Juan Valencia
(74) *Attorney, Agent, or Firm* — Abelman, Frayne & Schwab

(57) ABSTRACT

In an FCC process and system, a whole crude oil feedstock is directly converted into light olefins and other products. The feed is separated into a high boiling fraction and a low boiling fraction, and each fraction is processed in separate FCC downflow reactors. The catalyst, combined from both downflow reactors, is regenerated in a common vessel. The low carbon content in the catalyst particles from the low boiling fraction downflow reactor is insufficient to provide the necessary heat. By combining catalyst particles from the high boiling fraction having high carbon content helps to provide additional heat for regeneration.

11 Claims, 3 Drawing Sheets

(56) References Cited

U.S. PATENT DOCUMENTS

| | | | |
|---|---|---|---|
| 7,220,351 | B1 | 5/2007 | Pontier et al. |
| 8,231,777 | B2 | 7/2012 | Silva et al. |
| 2011/0226668 | A1 | 9/2011 | Dean et al. |
| 2011/0240520 | A1 | 10/2011 | Dean |
| 2013/0137909 | A1 | 5/2013 | Dean |

* cited by examiner

PROCESS FOR HIGH SEVERITY CATALYTIC CRACKING OF CRUDE OIL

RELATED APPLICATIONS

This application claims priority to provisional patent application number U.S. Ser. No. 61/716,051 filed Oct. 19, 2012, the contents of which are incorporated herein by reference.

BACKGROUND OF THE INVENTION

1. Field of the Invention

The present invention relates to a fluidized catalytic cracking process to produce petrochemicals such as olefins and aromatics and improved quality distillate product.

2. Description of Related Art

Olefins (i.e., ethylene, propylene, butylene and butadiene) and aromatics (i.e., benzene, toluene and xylene) are basic building blocks which are widely used in the petrochemical and chemical industries. Thermal cracking, or steam pyrolysis, is a major type of process for forming these materials, typically in the presence of steam, and in the absence of oxygen. Feedstocks for steam pyrolysis can include petroleum gases and distillates such as naphtha, kerosene and gas oil. The availability of these feedstocks is usually limited and requires costly and energy-intensive process steps in a crude oil refinery. These compounds are also produced through refinery fluidized catalytic cracking (FCC) process using typical heavy feedstocks such as gas oils or residues. FCC units produce a significant portion of propylene for the global market.

In FCC processes, petroleum derived hydrocarbons such as heavy feedstocks are catalytically cracked with an acidic catalyst maintained in a fluidized state, which is regenerated on a continuous basis. The main product from such processes has generally been gasoline. Other products are also produced in smaller quantities via FCC processes such as liquid petroleum gas and cracked gas oil. When the heavier feed contacts the hot catalyst and is cracked to lighter products, carbonaceous deposits, commonly referred to as coke, form on the catalyst and deactivate it. The deactivated, or spent, catalyst is separated from the cracked products, stripped of removable hydrocarbons and passed to a regeneration vessel where the coke is burned from the catalyst in the presence of air to produce a substantially regenerated catalyst. The combustion products are removed from the vessel as flue gas. The heated regenerated catalyst is then recycled to the reaction zone in the FCC unit. A general description of the FCC process is provided in U.S. Pat. No. 5,372,704, the complete disclosure of which is incorporated herein by reference.

FIG. 1 plots ranges for general types of technology used to upgrade atmospheric residues (350° C.+) from crude oils. Feeds to be converted in the FCC process should satisfy certain criteria in terms of the metals content and the Conradson Carbon Residue (CCR) or Ramsbottom carbon content as seen in FIG. 1. For instance, residual oils have a large percentage of refractory components such as polycyclic aromatics which are difficult to crack and promote coke formation in addition to the coke formed during catalytic cracking reactions. Because of the high Conradson carbon content, the burning load on the regenerator is increased requiring modifications and upgrades. In addition, these feeds can contain large amounts of metals including nickel and vanadium, which rapidly deactivate the FCC catalyst.

Limiting the amount of resid in the FCC feed has been the most common method in controlling regeneration temperature. Consideration has also been given to integrating catalyst coolers and two-stage regenerator systems. Feeds with up to about 3 wt % CCR can be processed in single stage regenerators, increasing to 6-7 wt % CCR in single stage regenerators with catalyst coolers and to about 10-11 wt % CCR with two-stage units with catalyst coolers. Hydrotreating the heavy feeds prior to cracking is also known to overcome these issues, necessitating higher capital costs and make-up hydrogen sources. FIG. 2 shows the distribution of feeds conventionally used within the FCC processes worldwide [SFA Pacific, Phase 8].

Other lighter feedstocks such as olefinic or paraffinic naphtha are also considered as possible FCC feeds to optimize propylene yield. Because of the comparatively low tendency in forming coke necessary for the heat balance of the FCC unit, naphtha co-processing schemes have been proposed with various configurations within a classical FCC process [Catalysis Today 106 (2005) 62-71]. It is known to combine naphtha with the feed and introduce the combined feed through the same injectors, incorporating a naphtha feed via a riser downstream of the feed injection system, injecting a naphtha feed upstream of the feed injectors (where it is cracked at higher temperature and catalyst-to-oil ratio (C/O) than in classical cracking) and integrating a second reaction zone in which a light naphtha fraction is cracked at higher severity levels.

Conventional feedstocks for FCC process are usually available in relatively limited quantity and are derived from costly and energy intensive processing steps within the refinery. To be able to respond to the growing demand of petrochemicals like propylene, other type of feeds which can be made available in larger quantities, such as raw crude oil, are attractive to producers. Using crude oil feeds will minimize or eliminate the likelihood of the refinery being a bottleneck in the production of these necessary petrochemicals.

Converting raw crude oil in conventional petrochemical manufacturing processes is challenging. In the case of FCC processes, a primary concern is the accelerated deactivation of catalyst due to the presence of comparatively high content of metals and coke precursors.

In addition, operating conditions such as temperature can be difficult to define due to the very wide boiling temperature range of a crude oil feed. Crude oil contains different components that have different cracking reactivity. The components found in the lower boiling temperature fractions, e.g. alkanes in the naphtha range, are typically very less reactive than, for instance, alkyl side chains of naphthenes components present in heavier boiling temperature fractions. According to known teachings, operating conditions employed for a comparatively wider range of boiling temperatures in the feed relative to conventional FCC processes minimizes optimal conversion of the different components. This is clearly illustrated by Corma et al. [Applied Catal. A: General 265 (2004) 195] in which a feed composed of 15 wt % light straight run (LSR) naphtha and 85 wt % gas oil was cracked in a micro downer testing unit. At an operating temperature of 550° C., and using a blend of two catalysts including one designed to promote naphtha cracking, the LSR naphtha does not crack but instead acts as diluents for the gas oil and lowers the overall gas oil conversion.

Conventionally known and commercially operable FCC apparatus and processes can employ multiple reactor stages and rely on feedstocks ranging from naphtha and gas oils to residual oils, which can be limited in availability or must undergo costly and energy intensive refinery processing steps. Therefore a need remains in the industry for efficient FCC apparatus and processes that can maximize production of petrochemicals such as light olefins, e.g., propylene, while minimizing or obviating the need for refinery processing steps to prepare the feedstock.

SUMMARY OF THE INVENTION

The system and process herein provides a fluid catalytic cracking process concerned with maximizing the production of light olefins, and particularly of propylene, using readily available raw crude oil as a starting feedstock within a two down-flow reaction zones operated at high severity conditions. In the FCC process and system, the feedstock is whole crude oil feedstock and is directly converted into light olefins and other products. The feed is separated into a high boiling fraction and a low boiling fraction, and is processed in separate FCC downflow reactors. The catalyst, combined from both downflow reactors, is regenerated in a common vessel. The low carbon content in the catalyst particles from the low boiling fraction downflow reactor is insufficient to provide the necessary heat. By combining catalyst particles from the high boiling fraction having high carbon content helps to provide additional heat for regeneration.

As used herein, the term "crude oil" is to be understood to mean a mixture of petroleum liquids and gases, including impurities such as sulfur-containing compounds, nitrogen-containing compounds and metal compounds, as distinguished from fractions of crude oil. In certain embodiments the crude oil feedstock is a minimally treated light crude oil to provide a crude oil feedstock having total metals (Ni+V) content of less than 5 ppm and Conradson carbon residue of less than 5 wt %. A wider range of crude oil can be accommodated by the present process, including light grade crude oil with low coke formation tendency, in particular in embodiments in which heavy cycle oil and/or slurry oil is recycled to the downflow reactor processing the light fraction, whereby the recycle stream maintains heat balance of the operation.

Other aspects, embodiments, and advantages of the process of the present invention are discussed in detail below. Moreover, it is to be understood that both the foregoing information and the following detailed description are merely illustrative examples of various aspects and embodiments, and are intended to provide an overview or framework for understanding the nature and character of the claimed features and embodiments. The accompanying drawings are illustrative and are provided to further the understanding of the various aspects and embodiments of the process of the invention.

BRIEF DESCRIPTION OF THE DRAWINGS

The invention will be described in further detail below and with reference to the attached drawings where.

DETAILED DESCRIPTION OF THE INVENTION

Figure 1:
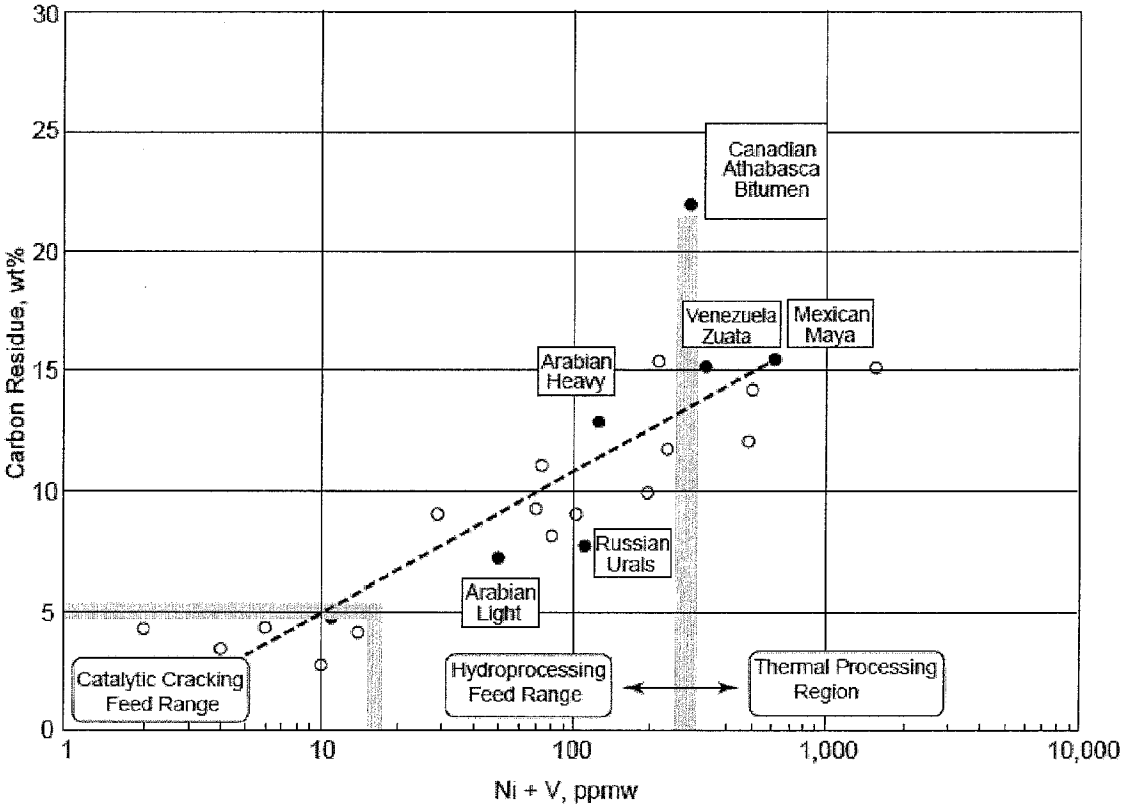
FIG. 1 is a plot of carbon residue content against metals (Ni and V) for general types of technology used to upgrade atmospheric residues (350° C.+) from crude oils derived from various sources.
Figure 2:
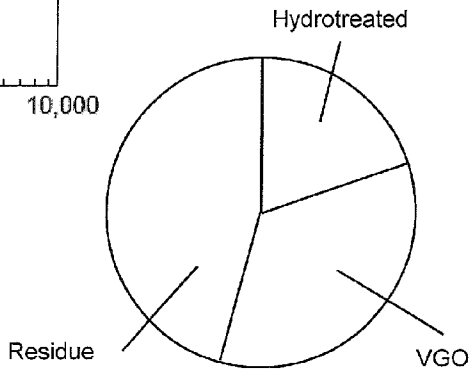
FIG. 2 is a pie chart showing the distribution of feeds conventionally used within the FCC processes worldwide.
Figure 3:
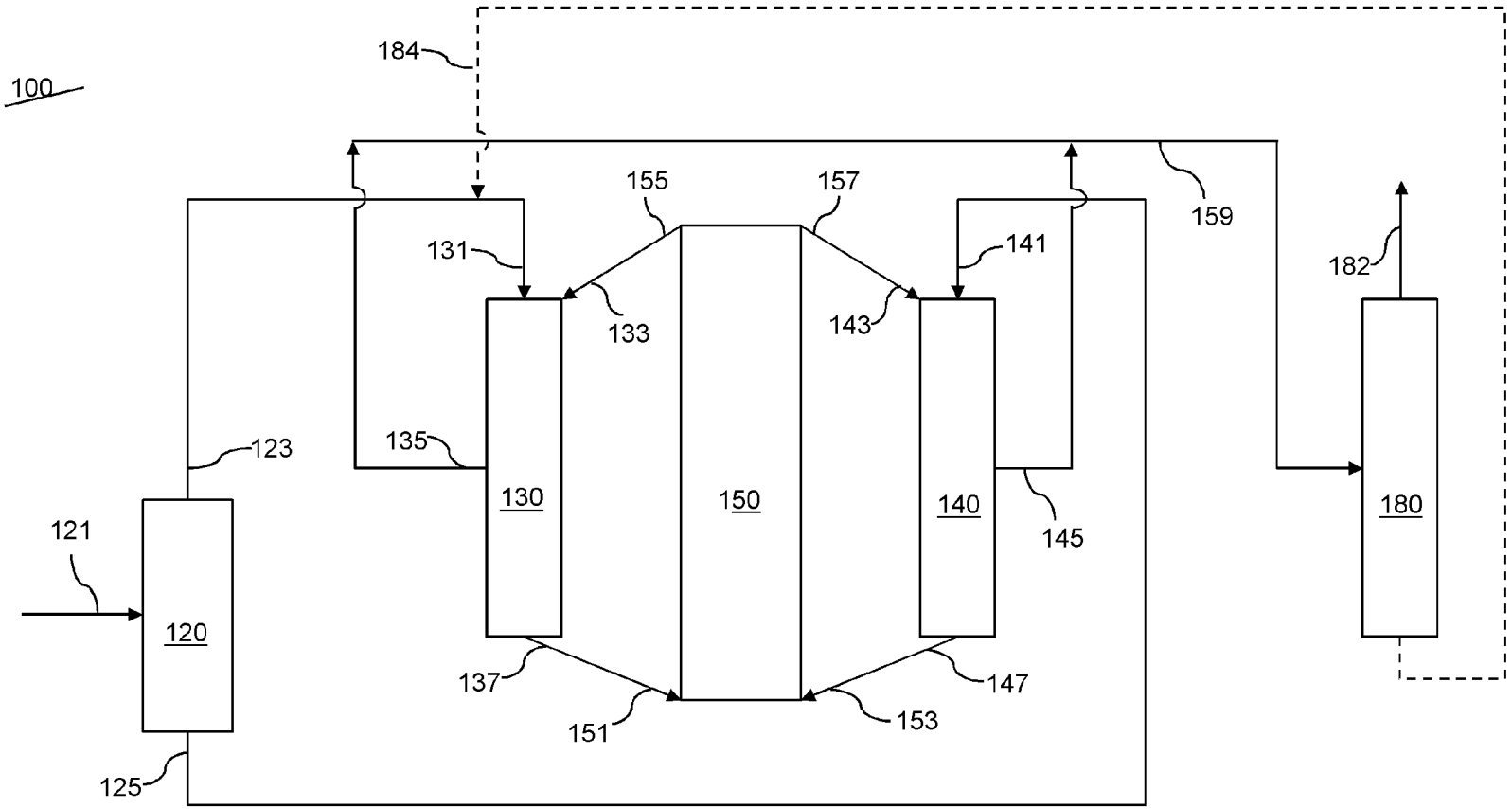
FIG. 3 is a flow diagram of the process described herein.

A process flow diagram including an integrated FCC process and system is shown in FIG. 3. The integrated system 100 generally includes a flash column 120, a high severity FCC zone having two downflow reactors 130 and 140, and a regenerator zone 150.

Flash column 120 includes an inlet 121 receiving a feedstock, an outlet 123 for discharging a low boiling fraction and an outlet 125 for discharging a high boiling fraction.

Downflow reactor 130 includes an inlet 131 in fluid communication with outlet 123 of flash column 120 for receiving the low boiling fraction, an inlet 133 for receiving regenerated catalyst. Downflow reactor 130 also includes an outlet 135 for discharging cracked products, and an outlet 137 for discharging spent catalyst. In certain optional embodiments, a heavy residue stream 184 is also introduced in the downflow reactor 130.

Downflow reactor 140 includes an inlet 141 in fluid communication with outlet 125 of flash column 120 for receiving the high boiling fraction, an inlet 143 for receiving regenerated catalyst. Downflow reactor 140 also includes an outlet 145 for discharging cracked products, and an outlet 147 for discharging spent catalyst. Cracked products 159 discharged from outlets 135 and 145 are separated in a separation zone 180 generally to produce cracked products 182 and cycle oil 184 which is optionally recycled to the downflow reactor 130 as described herein.

Figure 4:
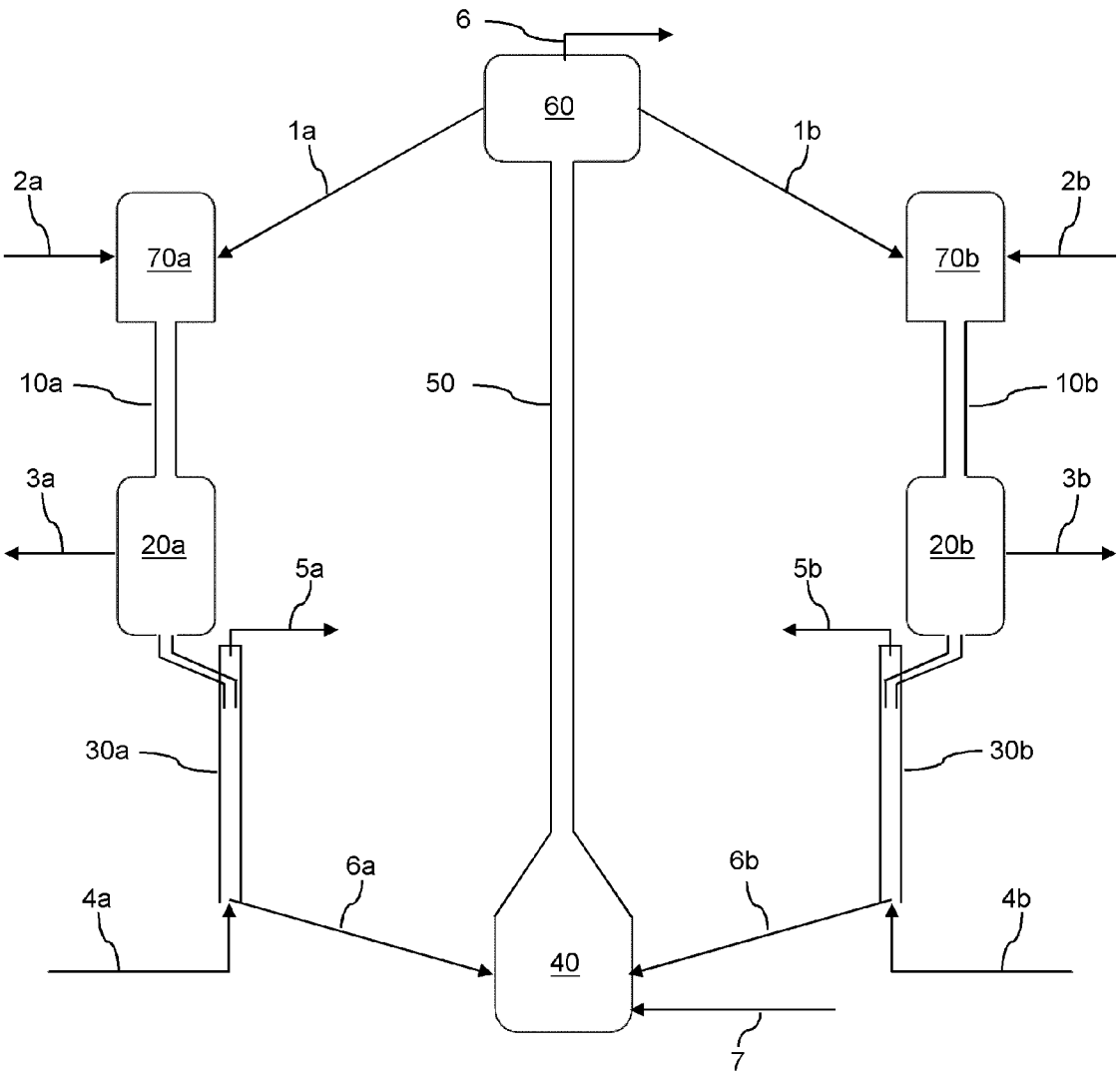
FIG. 4 is a schematic diagram of a two reaction zone FCC process described herein.

Each of the downflow-type reactors includes associated therewith a mixing zone, a separator and a catalyst-stripping zone, as shown and described in greater detail with respect to FIG. 4.

Regenerator 150 is shared by downflow reactors 130, 140 and includes an inlet 151 in fluid communication with outlet 137 of downflow reactor 130 for receiving the spent catalyst, and an inlet 153 in fluid communication with outlet 147 of downflow reactor 140 for receiving the spent catalyst. Regenerator 150 also includes an outlet 155 in fluid communication with inlet 133 of downflow reactor 130 for discharging the regenerated catalyst, and an outlet 157 in fluid communication with inlet 143 of downflow reactor 140 for discharging the regenerated catalyst.

A suitable feedstock to flash column 120 is a crude oil having total metals (Ni+V) content of less than 5 ppm and a Conradson carbon residue of less than 5 wt %. This feedstock is first sent to flashing column 120 to be fractionated into a low boiling fraction 123 and a high boiling fraction 125. The temperature of the flashing is in a range such that the high boiling fraction 125 contains less than 10 wt % of Conradson Carbon and less than 10 ppm of total metals.

A detailed diagram of an FCC system utilized in the integrated process described herein is provided in FIG. 4. The FCC system includes two reaction zones 10*a* and 10*b*, two gas-solid separation zones 20*a* and 20*b*, two stripping zones 30*a* and 30*b*, a regeneration zone 40, a transfer line 50, a catalyst hopper 60 and two mixing zones 70*a* and 70*b*.

Mixing zone 70*a* has an inlet 2*a* for receiving the low boiling fraction, an inlet 1*a* for receiving regenerated catalyst, and an outlet for discharging a hydrocarbon/catalyst mixture. Reaction zone 10*a* has an inlet in fluid communication with the outlet of mixing zone 70*a* for receiving the hydrocarbon/catalyst mixture, and an outlet for discharging a mixture of cracked products and spent catalyst. Separation zone 20*a* includes an inlet in fluid communication with the outlet of reaction zone 10*a* for receiving the mixture of cracked products and spent catalyst, an outlet 3*a* for discharging separated cracked products, and an outlet for discharging spent catalyst with remaining hydrocarbons. Stripping zone 30*a* includes an inlet in fluid communication with the outlet of separation zone 20*a* for receiving the spent catalyst with remaining hydrocarbons, and an inlet 4*a* for receiving stripping steam.

Stripping zone 30*a* also includes an outlet 5*a* for discharging recovered product, and an outlet 6*a* for discharging spent catalyst.

Mixing zone 70*b* has an inlet 2*b* for receiving the high boiling fraction, an inlet 1*b* for receiving regenerated catalyst, and an outlet for discharging a hydrocarbon/catalyst mixture. Reaction zone 10*b* has an inlet in fluid communication with the outlet of mixing zone 70*b* for receiving the hydrocarbon/catalyst mixture, and an outlet for discharging a mixture of cracked products and spent catalyst. Separation zone 20*b* includes an inlet in fluid communication with the outlet of reaction zone 10*b* for receiving the mixture of cracked products and spent catalyst, an outlet 3*b* for discharging separated cracked products, and an outlet for discharging spent catalyst with remaining hydrocarbons. Stripping zone 30*b* includes an inlet in fluid communication with the outlet of separation zone 20*b* for receiving the spent catalyst with remaining hydrocarbons, and an inlet 4*b* for receiving stripping steam. Stripping zone 30*b* also includes an outlet 5*b* for discharging recovered product, and an outlet 6*b* for discharging spent catalyst.

Regeneration zone 40 includes an inlet 7 for receiving combustion gas, an inlet in fluid communication with outlet 6*a* of stripping zone 30*a* for receiving spent catalyst, an inlet in fluid communication with outlet 6*b* of stripping zone 30*b* for receiving spent catalyst, and an outlet for discharging hot regenerated catalyst.

Transfer line 50 includes an inlet in fluid communication with the outlet of regeneration zone 40 for receiving hot regenerated catalyst, and an outlet for discharging moderately cooled regenerated catalyst.

Catalyst hopper 60 includes an inlet in fluid communication with the outlet of transfer line 50 for receiving the cooled regenerated catalyst, an outlet 6 for discharging fuel gases, an outlet in fluid communication with inlet 1*a* of the mixing zone 70*a* for discharging regenerated catalyst, and an outlet in fluid communication with inlet 1*b* of the mixing zone 70*b* for discharging regenerated catalyst.

In a process employing the arrangement shown in FIG. 3, a crude oil feedstock having a total metals (Ni+V) content of less than 5 ppm and Conradson carbon residue of less than 5 wt % is fractioned into low boiling fraction 123 and high boiling fraction 125 in flash column 120 at a temperature in a range such that the high boiling fraction 125 contains less than 10 wt % of Conradson Carbon and less than 10 ppm of total metals. Both fractions 123, 125 are then sent to downflow reactors 130, 140, respectively, of the FCC unit as described in more detail below. Optionally, a residue stream 184 can be also introduced in the downflow reactor 130 along with the low boiling fraction 123. This stream 184 can be recycled cycle oil or slurry oil from the downstream FCC unit product separator 180, or from another source (not shown). The additional feed sent to the downer reactor processing the light fraction results in a higher coke yield to be further burnt in the regenerator. The products 159 from the two reaction zones are sent to fractionator 180 where the heavy fraction product are removed from the product stream 159. When required, cycle oil and/or slurry oil, stream 184, resulting from the cracking reactions (e.g., partially converted or unconverted hydrocarbons) is recycled. The recycle feed is mixed with the light boiling fraction stream 123, e.g., in the mixing zone 70*a* described with respect to FIG. 4, and sent to the downer reactor in which higher temperatures permit a higher coke yield to be further burnt in the regenerator ensuring heat balance is maintained.

As shown in FIG. 4, hot catalyst from the regenerator zone 40 is received in a withdrawal well or hopper 60 via where it stabilizes before being introduced via lines 1*a* and 1*b* into the respective mixing zones 70*a* and 70*b*.

The low boiling fraction is introduced into mixing zone 70*a* via inlet 2*a*, and mixed with regenerated catalyst that is conveyed to mixing zone 70*a* via inlet 1*a*. The mixture is passed to reaction zone 10*a* and cracked under the following conditions: a temperature in the range of from about 932-1300° F. (about 500-704° C.) and in certain embodiments in the range of from about 1022-1292° F. (about 550-700° C.); a catalyst-oil ratio in the range of from about 20:1 to 60:1; and a residence time in the range of from about 0.2 to 2 seconds. The mixture of cracked products and spent catalyst is passed to separation zone 20*a* and separated into cracked products discharged via outlet 3*a* and spent catalyst which is conveyed to stripping zone 30*a*. Cracked products include ethylene, propylene, butylene, gasoline (from which aromatics such as benzene, toluene and xylene can be obtained), and other by-products from the cracking reactions. Cracked products can be recovered separately in a segregated recovery section (not shown) or combined for further fractionation and eventual recovery via outlet 159 (FIG. 3). Spent catalyst is washed in the stripping zone 30*a* with stripping steam introduced via inlet 4*a*. Remaining hydrocarbon gases pass through cyclone separators (not shown) and are recovered via outlet 5*a*, and cleaned spent catalyst is conveyed to regeneration zone 40 via outlet 6*a*.

The high boiling fraction is introduced into mixing zone 70*b* via inlet 2*b*, and mixed with regenerated catalyst that is conveyed to mixing zone 70*b* via inlet 1*b*. The mixture is passed to reaction zone 10*b* and cracked under the following conditions: a temperature in the range of from about 932-1300° F. (about 500-704° C.) and in certain embodiments in the range of from about 932-1202° F. (about 500-650° C.); a catalyst-oil ratio in the range of from about 20:1 to 40:1; and a residence time in the range of from about 0.2 to 2 seconds. The mixture of cracked products and spent catalyst is passed to separation zone 20*b* and separated into cracked products discharged via outlet 3*b* and spent catalyst which is conveyed to stripping zone 30*b*. Cracked products include ethylene, propylene, butylene, gasoline, and other by-products from the cracking reactions. Cracked products can be recovered separately in a segregated recovery section (not shown) or combined for further fractionation and eventual recovery via outlet 159 (FIG. 3). Spent catalyst is washed in the stripping zone 30*b* with stripping steam introduced via inlet 4*b*. Remaining hydrocarbon gases pass through cyclone separators (not shown) and are recovered via outlet 5*b*, and cleaned spent catalyst is conveyed to regeneration zone 40 via outlet 6*b*.

In regeneration zone 40, spent catalyst is regenerated via controlled combustion in the presence of combustion gas, such as pressurized air, introduced via inlet 7. The regenerated catalyst is raised through transfer line 50 to provide heat for the endothermic cracking reaction in reaction zones 10*a* and 10*b*.

The regenerated catalyst from the regeneration zone 40 is transferred to catalyst hopper 60 which functions as a gas-solid separator to remove fuel gases that contain by-products of coke combustion via outlet 6. The regenerated catalyst is recycled to mixing zones 70*a* and 70*b* through downer lines 1*a* and 1*b*, respectively.

The catalyst used in the process described herein can be conventionally known or future developed catalysts used in FCC processes, e.g., zeolites, silica-alumina, carbon monoxide burning promoter additives, bottoms cracking additives, light olefin-producing additives and any other catalyst additives routinely used in the FCC process. In certain embodiments a suitable cracking zeolites in the FCC process include zeolites Y, REY, USY, and RE-USY. For enhanced naphtha cracking potential, a preferred shaped selective catalyst additive can be employed, e.g., as used in FCC processes to produce light olefins and increase FCC gasoline octane is ZSM-5 zeolite crystal or other pentasil type catalyst structure. This ZSM-5 additive can be mixed with the cracking catalyst zeolites and matrix structures in conventional FCC catalyst and is particularly suitable to maximize and optimize the cracking of the crude oil fractions in the downflow reaction zones.

Accordingly, the process herein uses a crude oil as a raw material, with no preprocessing or minimal preprocessing to reduce the Conradson carbon residue content and the total metals content, for direct conversion into light olefins within the FCC process having two down-flow reactors operating in high severity modes.

A particular advantage concerns the amount of coke produced from the cracking reaction of the high boiling fraction in reaction zone 10*b* that will compensate for the limited amount of coke that forms from the cracking reaction of the low boiling fraction in reaction zone 10*a*. For instance in cracking of a paraffinic naphtha feed which is a low boiling fraction, the overall unit operational efficiency is adversely effected by the limited amount of coke produced during the cracking reactions in the reactor. The amount of coke produced is not sufficient to produce enough heat during catalyst regeneration to allow for the naphtha cracking reactions to occur in the downflow reactor. By comparison, the coke produced during cracking of the heavy oil which is high boiling fraction in the second downflow reactor is more than adequate to provide the required heat to both downflow reactors 10*a* and 10*b*. In the method of the invention, this heat is transferred from the regenerator to both downflow reactors by the regenerated catalyst by mixing the spent catalyst from the two sources during the regeneration processing in vessel 40.

For the purpose of this simplified schematic illustration and description, the numerous valves, temperature sensors, electronic controllers and the like that are customarily employed and well known to those of ordinary skill in the art of fluid catalyst cracking are not included. Accompanying components that are in conventional hydrocracking units such as, for example, bleed streams, spent catalyst discharge sub-systems, and catalyst replacement sub-systems are also not shown. Further, accompanying components that are in conventional FCC systems such as, for example, air supplies, catalyst hoppers and flue gas handling are not shown.

EXAMPLES

The following examples detail fluidized catalytic cracking of Arab extra light crude oil to demonstrate the enhancements provided by employing a dual downer confirmation in which light and heavy fractions are cracked in separate downers, as compared to cracking the crude stream in a single downer.

Comparative Example 1

As a first comparative example, the full crude oil feedstream was catalytically cracked at 600° C. and a catalyst-to-oil ratio of 31.

Example 1

Using the process disclosed herein in which the feedstock is fractioned into a low boiling fraction and a high boiling fraction, the crude oil feedstream was fractioned at a cut point of 300° C. Each fraction was sent to separate downers of a dual downer configuration for catalytic cracking at a cracking temperature of 600° C. in both downers. Each downer was operated at a catalyst-to-oil ratio of 31. The gasoline yield was 45.8 wt % for the heavy fraction and 54.2 wt % for the light fraction.

Overall product yields for both the comparative operation and the new operation are in Table 1, in which the products in the dual downer configuration were recombined.

TABLE 1

| Product Yields, wt % | | |
|---|---|---|
| | Single Downer Products (Comparative 1) | Dual Downer Products, Recombined (Example 1) |
| Ethylene | 3.6% | 3.6% |
| Propylene | 13.1% | 13.5% |
| Butene | 9.4% | 9.0% |
| Dry Gas | 5.5% | 5.5% |
| Gasoline | 47.9% | 47.2% |
| LCO | 13.9% | 15.4% |
| HCO | 2.8% | 3.5% |
| Coke | 2.8% | 2.5% |

Comparative Example 2

As a second comparative example, the full crude oil feedstream was catalytically cracked at 600° C. and a catalyst-to-oil ratio of 20.

Example 2

Using the process disclosed herein in which the feedstock is fractioned into a low boiling fraction and a high boiling fraction, the crude oil feedstream was fractioned at a cut point of 300° C. Each fraction was sent to separate downers of a dual downer configuration for catalytic cracking at a cracking temperature of 600° C. in both downers. Each downer was operated at a catalyst-to-oil ratio of 20. Product yields for both the comparative operation and the new operation are in Table 2, in which the products in the dual downer configuration were recombined.

TABLE 2

| Product Yields, wt % | | |
|---|---|---|
| | Single Downer Products (Comparative 2) | Dual Downer Products, Recombined (Example 2) |
| Ethylene | 3.2% | 3.0% |
| Propylene | 11.6% | 11.7% |
| Butene | 8.6% | 8.3% |
| Dry Gas | 5.2% | 4.9% |
| Gasoline | 47.5% | 48.9% |
| LCO | 16.7% | 17.1% |
| HCO | 3.8% | 4.2% |
| Coke | 2.4% | 2.2% |

Example 3

Using the process disclosed herein in which the feedstock is fractioned into a low boiling fraction and a high boiling fraction, the crude oil feedstream was fractioned at a cut point of 300° C. Each fraction was sent to separate downers of a dual downer configuration for catalytic cracking. The downer for the heavy fraction was operated at a cracking temperature of 600° C. and a catalyst-to-oil ratio of 31 and the downer for the light fraction was operated at a cracking temperature of 640° C. and a catalyst-to-oil ratio of 32. Product yields for both the comparative operation (comparative example 1) and the new operation are in Table 3, in which the products in the dual downer configuration were recombined.

TABLE 3

| | Product Yields, wt % | |
|---|---|---|
| | Single Downer Products (Comparative 1) | Dual Downer Products, Recombined (Example 3) |
| Ethylene | 3.6% | 5.2% |
| Propylene | 13.1% | 15.8% |
| Butene | 9.4% | 10.3% |
| Dry Gas | 5.5% | 8.5% |
| Gasoline | 47.9% | 43.1% |
| LCO | 13.9% | 13.1% |
| HCO | 2.8% | 3.4% |
| Coke | 2.8% | 2.5% |

It is observed that at the same cracking temperature of temperature of 600° C., similar yields of propylene, butenes, ethylene, dry gas and coke are obtained in processes using the single downer scheme or the dual downer scheme disclosed herein. However, the gasoline component yields, as shown using PIONA analyses (in which the content of paraffin, isoparaffin, olefin, naphthene and aromatic compounds are determined) demonstrates qualitative improvements. In particular, although the overall gasoline yields are similar, as shown above in Tables 1 and 2, the quality of the gasoline derived from the dual downer configuration is improved by producing higher amount of aromatics and olefins and lower amounts of paraffins, isoparaffins and naphthenes. Accordingly, the Research Octane Number (RON) and the Motor Octane Number (MON) ratings are improved when the low boiling and high boiling fractions are cracked separately as compared to schemes in which the crude oil feed is cracked in a single downer. Table 4 summarizes the PIONA analyses for the examples and comparative examples disclosed herein.

TABLE 4

| | Comparative Example 1 | Comparative Example 2 | Example 1 | Example 2 |
|---|---|---|---|---|
| Cat/Oil, wt/wt | 31 | 20 | 31 | 20 |
| Temperature (° C.) | 600 | 600 | 600 | 600 |
| Gasoline Fraction (wt %) | 47.9 | 47.5 | 47.2 | 48.9 |
| Total by class (wt %) | | | | |
| Paraffins | 22.8 | 22.4 | 20.06 | 17 |
| Iso-Paraffins | 24.2 | 23.6 | 18.54 | 18.2 |
| Olefins | 16.7 | 16.4 | 23.46 | 25.3 |
| Naphthenes | 11.5 | 11.7 | 9.67 | 9.9 |
| Aromatics | 23.5 | 24.5 | 30.24 | 28.5 |
| Unidentified | 1.4 | 1.4 | 1.1 | 1.2 |
| RON | 74.7 | 75.1 | 79.4 | 79.1 |
| MON | 72.3 | 72.6 | 76.2 | 75.9 |

The method and system of the present invention have been described above and in the attached drawings; however, modifications will be apparent to those of ordinary skill in the art and the scope of protection for the invention is to be defined by the claims that follow.

The invention claimed is:

1. A method for processing a crude oil feedstock having total metals (Ni+V) content of less than 5 ppm and Conradson carbon residue of less than 5 wt % comprising:

fractionating the feedstock into a low boiling fraction and a high boiling fraction, wherein fractionating is conducted in a range temperature conducive to produce the high boiling fraction having less than 10 wt % Conradson Carbon and less than 10 ppm total metals;

cracking the low boiling fraction in a first downflow reaction zone of a fluid catalytic cracking unit in the presence of a predetermined amount of catalyst to produce a first cracked product stream and spent catalyst;

cracking the high boiling fraction in a second downflow reaction zone of the fluid catalytic cracking unit in the presence of a predetermined amount of catalyst to produce a second cracked product stream and spent catalyst;

wherein each of the first and second downflow reaction zones includes a mixing zone, a separation zone and a catalyst-stripping zone, and regenerating spent catalyst from both the first and second downflow reaction zones in a common regeneration zone and recycling the regenerated catalyst back to the first and second downflow reaction zones; and recovering the first and second cracked product streams, wherein heat formed by combustion of coke formed on catalyst particles having increased coke formation from the high boiling fraction reaction zone overcomes limitations associated with reduced coke formation on catalyst particles from the low boiling fraction reaction zone.

2. The process of claim 1, wherein the catalyst-oil ratio in the first downflow reaction zone is in the range of 20:1 to 60:1.

3. The process of claim 1, wherein the catalyst-oil ratio in the second downflow reactor is in the range of 20:1 to 40:1.

4. The process of claim 1, wherein the temperature in the first downflow reaction zone is in the range of 500° C. to 704° C.

5. The process of claim 1, wherein the temperature in the first downflow reaction zone is in the range of 550° C. to 700° C.

6. The process of claim 1, wherein the temperature in the second downflow reaction zone is in the range of 500° C. to 704° C.

7. The process of claim 1, wherein the temperature in the second downflow reaction zone is in the range of 500° C. to 650° C.

8. The process of claim 1, wherein the residence time in the first downflow reaction zone is in the range of 0.2 s to 5 s.

9. The process of claim 1, wherein the residence time in the second downflow reaction zone is in the range of 0.2 s to 2 s.

10. The process of claim 1, further comprising separating cycle oil and/or slurry oil from the recovered first and second cracked product streams.

11. The process of claim 10, wherein a portion of separated cycle oil and/or slurry oil is recycled to the first downflow reaction zone.

* * * * *